US005739736A

United States Patent [19]

Lee

[11] Patent Number: 5,739,736

[45] Date of Patent: Apr. 14, 1998

[54] MOUNTING ARRANGEMENT FOR A HIGH-VOLTAGE TRANSFORMER OF A MICROWAVE OVEN

[75] Inventor: Sung-Ho Lee, Suwon, Rep. of Korea

[73] Assignee: Samsung Electronics Co., Ltd., Suwon, Rep. of Korea

[21] Appl. No.: 731,133

[22] Filed: Oct. 10, 1996

[30] Foreign Application Priority Data

Jan. 6, 1996 [KR] Rep. of Korea ..... 96-135

[51] Int. Cl.[6] ..... H01F 27/02; H01F 27/06; H05B 6/64

[52] U.S. Cl. ..... 336/65; 336/90; 336/98; 219/760

[58] Field of Search ..... 219/235, 685, 219/756, 760; 336/65, 90, 98

[56] References Cited

U.S. PATENT DOCUMENTS

| | | | |
|---|---|---|---|
| 3,867,605 | 2/1975 | Yee | 219/10.55 D |
| 4,885,445 | 12/1989 | Taniguchi | 219/10.55 B |
| 5,111,013 | 5/1992 | Okada | 219/10.55 F |
| 5,534,681 | 7/1996 | Hwang | 219/685 |

*Primary Examiner*—Cassandra C. Spyrou
*Assistant Examiner*—Anh Mai
*Attorney, Agent, or Firm*—Burns. Doane, Swecker & Mathis, L.L.P.

[57] ABSTRACT

A microwave oven includes a compartment in which a magnetron and a high-voltage transformer are disposed. The transformer includes coils disposed within a core. The core has holes formed in its underside, which are aligned with respective through-holes formed in a bottom panel of the compartment. Bolts extend upwardly through the through holes and into the holes to secure the transformer directly to the bottom panel.

3 Claims, 3 Drawing Sheets

FIG. 1
(PRIOR ART)
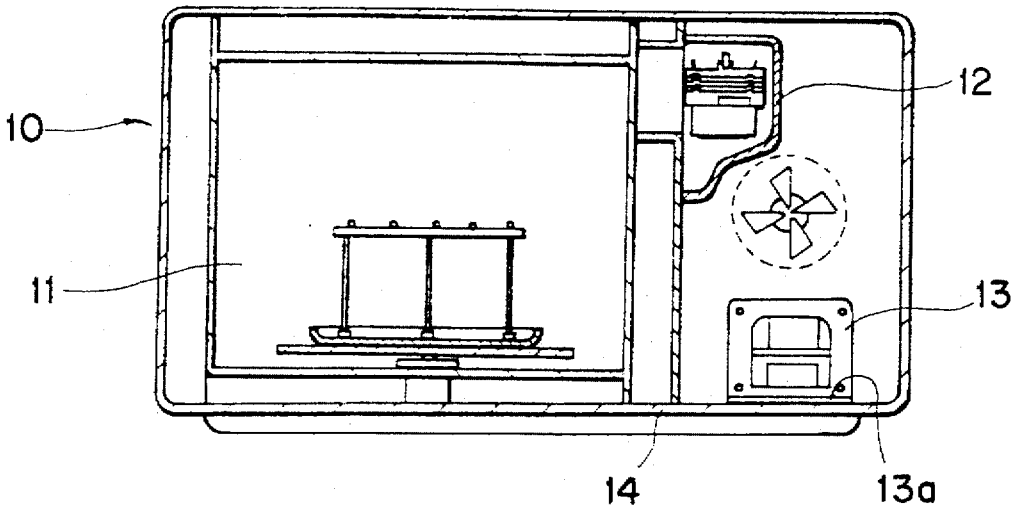
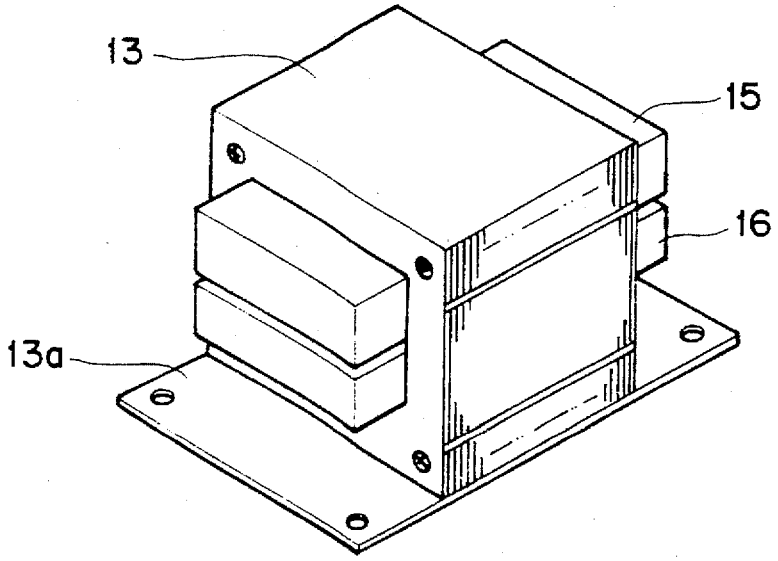
FIG. 2
(PRIOR ART)

MOUNTING ARRANGEMENT FOR A HIGH-VOLTAGE TRANSFORMER OF A MICROWAVE OVEN

BACKGROUND OF THE INVENTION

1. Field of the Invention

The present invention relates to a high voltage transformer assembly apparatus for a microwave oven.

2. Description of the Prior Art

Generally, a microwave oven is, at one side of a body 10, as illustrated in FIG. 1 provided with a cooking chamber 11 for being electrically sealed to thereby cook the food.

The body 10 is provided at the other side thereof with a magnetron 12 for supplying an electric field to the food (not shown) in the cooking chamber 11.

A high voltage transformer 13 is disposed underneath the body 10 at a predetermined distance from the magnetron 12 to supply a predetermined direct current power necessary for activation of the magnetron 12.

A conventional microwave oven disperses electronic waves by either a shower method for evenly dispersing the electronic waves into the cooking chamber 11 by means of a stirrer (not shown) which is a metal vane, or a turntable rotating method for rotating a dish on which the food is placed in the cooking chamber 11 to thereby disperse the electronic waves.

Meanwhile, the high-voltage transformer 13 applied to the conventional microwave oven is provided thereunder, as illustrated in FIG. 2, with a bracket 13, which is in turn mounted to a bottom panel 14 of the microwave oven (see FIG. 1) and fixed by bolts (not shown) and the like.

The high-voltage transformer 13 provided at an external side thereof with a primary coil 15 and also with a secondary coil 16 at a predetermined distance from the first coil 15.

The high-voltage transformer 13 serves to raise the voltage applied to the first coil to a high voltage of 2,100 v at the secondary coil 16 to thereby drive a magnetron 12.

However, there is a problem in the conventional high voltage transformer assembly apparatus in that the bracket involves an extra part that is required, and a complicated process is involved for mounting the bracket to the core. Also, the bracket occupies space that could be better used to provide access for other parts.

SUMMARY OF THE INVENTION

Accordingly, the present invention is provided to solve the aforementioned problems and it is an object of the present insertion to provide a high-voltage transformer apparatus of a microwave oven by which a high-voltage transformer can be easily mounted to a bottom panel by way of fastening means.

In accordance with the object of the present invention, there is provided a high-voltage transformer assembly apparatus disposed in a compartment of a microwave oven. The transformer assembly includes a core whose underside is formed with a plurality of fastening holes, and a bottom panel of the compartment is formed with a plurality of through holes to correspond to the plurality of fastening holes in the core to receive fasteners which integrally fix the transformer to the bottom panel.

BRIEF DESCRIPTION OF THE DRAWINGS

For a fuller understanding of the nature and objects of the invention, reference should be made to the following detailed description taken in conjunction with the accompanying drawings in which:

FIG. 1 is a sectional view for schematically illustrating an interior of a conventional microwave oven; FIG. 2 is a perspective view for illustrating a conventional high-voltage transformer;

DETAILED DESCRIPTION OF A PREFERRED EMBODIMENT OF THE PRESENT INVENTION

Figure 5:
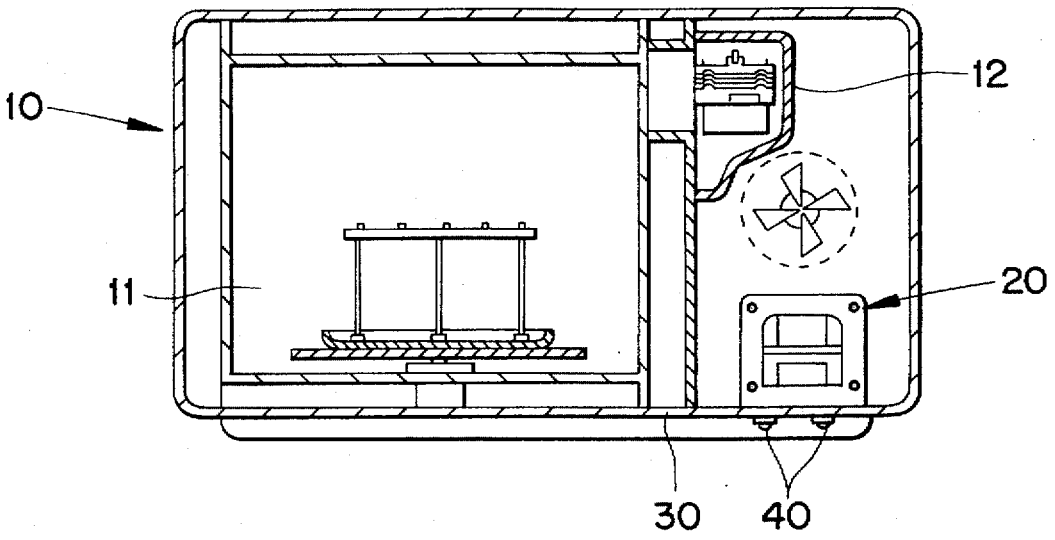
FIG. 5 is a view of the microwave oven similar to FIG. 1 but depicting a transformer according to the present invention.

Now, the high-voltage transformer assembly apparatus of a microwave oven according to the preferred embodiment of the present invention will be described in detail with reference to the accompanying drawings. FIG. 5 depicts the microwave oven of FIG. 1 except that a transformer assembly 20 according to the present invention is disposed therein. That is, the oven includes the body 10 forming the cooking chamber 11, the magnetron 12, and a magnetron assembly 20 secured to a bottom panel 30 of the oven.

Figure 3:
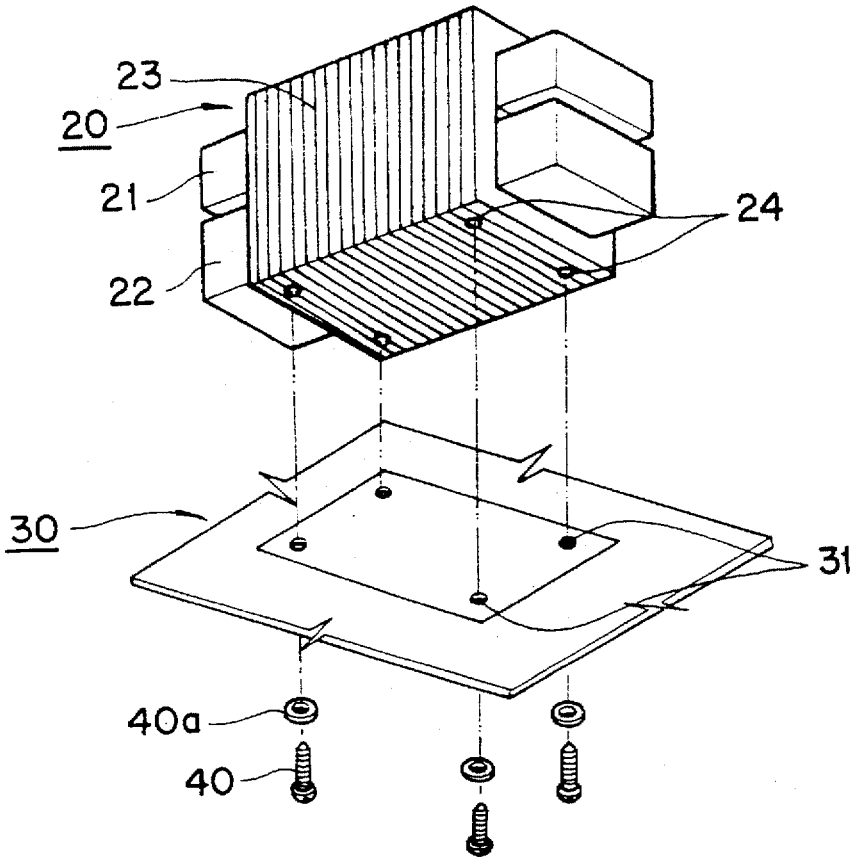
FIG. 3 is an exploded perspective view for illustrating a high-voltage transformer assembly apparatus according to one embodiment of the present invention.

FIG. 3 is an exploded perspective view for illustrating a disposed state of a high-voltage transformer assembly apparatus according to the embodiment of the present invention.

The high-voltage transformer assembly includes a high-voltage transformer 20 provided as illustrated in FIG. 3 with a primary coil 21 and a secondary coil 22 at a predetermined spacing therebetween, the coils being electrically insulated.

The primary coil 21 and the secondary coil 22 are encompassed by a core 23 for forming a magnetic field.

The core 23 is formed on its underside with a plurality of fastening holes 24 at a predetermined interval.

Meanwhile, a bottom panel 30 of the compartment of the microwave oven in which the high-voltage transformer 20 is fixedly disposed is formed with a plurality of through holes 31 corresponding in positions to the fastening holes 24.

Figure 4:
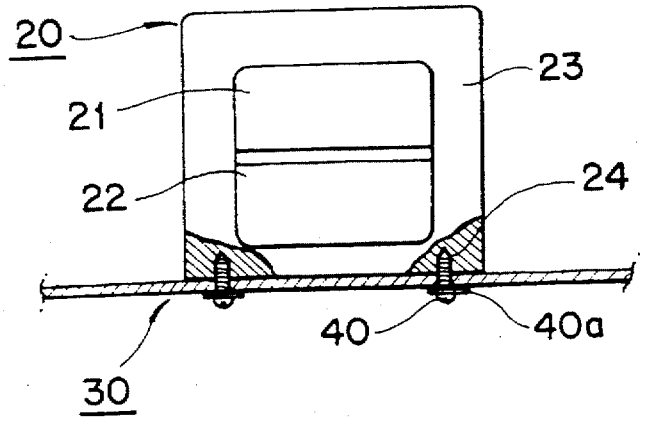
FIG. 4 is a sectional view for illustrating an assembled state of the transformer assembly depicted in FIG. 3.

FIG. 4 is a sectional view for illustrating an assembled state of the high-voltage transformer assembly apparatus.

According to FIG. 4, when the high-voltage transformer 20 is assembled, the through holes 31 of the bottom panel 30 and the fastening holes 24 of the core 23 are mutually aligned, and fastened by fastening means 40 through the medium of a washer 40*a*.

It is preferable that a bolt the be used as fastening means but a bolt with a washer can also be used.

Meanwhile, the depth of the fastening holes 24 is such that they do not touch the primary coil 21 and the secondary coil 22.

Accordingly, there is an advantage in the high-voltage transformer assembly apparatus of a microwave oven according to the present invention, in that a high-voltage transformer can be easily attached to a bottom panel without using a separate support bracket, to thereby reduce the assembly processes and the number of parts involved thereto.

Therefore, because there is no need for a separate support bracket, a wind passage corresponding thereto is formed to thereby cool the heat generated from electrical parts.

In short, there is an advantage in the high-voltage transformer assembly apparatus of a microwave oven according to the present invention, in that the number of parts and the difficulty of the assembly processes are decreased to thereby reduce the overall manufacturing cost.

What is claimed is:

1. A microwave oven comprising:

a housing forming a cooking chamber and a compartment disposed adjacent to the cooking chamber, the compartment including a bottom panel having a plurality of through-holes formed therein;

a magnetron disposed in the compartment for generating electromagnetic waves for cooking food in the cooking chamber;

a high-voltage transformer assembly disposed in the compartment and including a core and a pair of coils disposed therein, and underside of the core having a plurality of holes formed directly therein and aligned with respective ones of the through-holes, the transformer being electrically connected to the magnetron;

fastening means extending upwardly through respective ones of the through-holes and into respective ones of the holes for securing the core directly to the bottom panel.

2. The microwave according to claim 1 wherein the fastening means comprise bolts.

3. The microwave according to claim 2 further including washers through which respective bolts extend, each washer disposed between the underside of the bottom panel and a head of a respective bolt.

* * * * *